US006836989B2

(12) United States Patent
Gussalli Beretta

(10) Patent No.: US 6,836,989 B2
(45) Date of Patent: Jan. 4, 2005

(54) SAFETY DEVICE FOR A BREECHBLOCK OF A FIREARM

(75) Inventor: Ugo Gussalli Beretta, Brescia (IT)

(73) Assignee: Fabbrica D'Armi Pietro Beretta S.p.A., Brescia (IT)

( * ) Notice: Subject to any disclaimer, the term of this patent is extended or adjusted under 35 U.S.C. 154(b) by 38 days.

(21) Appl. No.: 10/414,861

(22) Filed: Apr. 16, 2003

(65) Prior Publication Data

US 2004/0200112 A1 Oct. 14, 2004

(30) Foreign Application Priority Data

Apr. 22, 2002 (IT) ..... MI2002A0854

(51) Int. Cl.[7] ..... F41A 17/00
(52) U.S. Cl. ..... 42/70.01; 42/70.08
(58) Field of Search ..... 42/70.08, 16, 70.01; 89/164, 168, 182, 174

(56) References Cited

U.S. PATENT DOCUMENTS

| | | | | | |
|---|---|---|---|---|---|
| 891,510 | A | * | 6/1908 | Tansley | 42/70.08 |
| 2,715,356 | A | * | 8/1955 | Fiorini | 42/70.08 |
| 2,931,120 | A | | 4/1960 | Kolin | |
| 3,670,442 | A | * | 6/1972 | Kennedy et al. | 42/70.08 |
| 3,813,803 | A | * | 6/1974 | Eder et al. | 42/16 |
| 3,918,347 | A | * | 11/1975 | Pierre et al. | 89/141 |
| 3,938,423 | A | * | 2/1976 | Schertz | 89/176 |
| 4,210,059 | A | * | 7/1980 | Munn | 89/132 |
| 4,450,751 | A | * | 5/1984 | Thevis | 89/129.02 |
| 4,454,673 | A | * | 6/1984 | Meidel | 42/70.08 |
| 4,590,697 | A | * | 5/1986 | Ruger et al. | 42/70.08 |
| 4,697,495 | A | * | 10/1987 | Beretta | 89/143 |
| 4,730,538 | A | * | 3/1988 | Zamacola | 89/154 |
| 5,267,406 | A | * | 12/1993 | Ruger et al. | 42/25 |
| 5,386,659 | A | * | 2/1995 | Vaid et al. | 42/69.02 |
| 5,426,880 | A | * | 6/1995 | Ruger et al. | 42/69.03 |
| 5,437,120 | A | * | 8/1995 | Dornaus | 42/70.08 |
| 5,736,667 | A | * | 4/1998 | Munostes et al. | 89/132 |
| 5,867,928 | A | * | 2/1999 | Plebani | 42/17 |
| 5,903,994 | A | * | 5/1999 | Tange | 42/70.01 |
| 6,145,234 | A | * | 11/2000 | Fluhr | 42/70.08 |

FOREIGN PATENT DOCUMENTS

DE 13 00 846 8/1969

OTHER PUBLICATIONS

Epo Search Report.

* cited by examiner

*Primary Examiner*—Michael J. Carone
*Assistant Examiner*—L. Semunegus
(74) *Attorney, Agent, or Firm*—Hedman & Costigan, P.C.

(57) ABSTRACT

A safety device for a breechblock of a firearm suitable for limiting accidental sliding of a breechblock (14) following knocks to the firearm, comprises a locking lever (15) of the breechblock (14), pivoted to the structure of the firearm in an axis (11) and an elastic return element (18) of the lever (15), suitable for keeping it is rest position in conditions of normal use of the firearm, the locking lever (15) being equipped with an engagement element (19) for intervention in a seat (20) of the breechblock (14) and with a center of gravity (G) which is offset with respect to the axis of rotation (11) of the lever (15), suitable for causing its inertial rotation in a middle plane of line (21).

13 Claims, 5 Drawing Sheets

SAFETY DEVICE FOR A BREECHBLOCK OF A FIREARM

FIELD OF THE INVENTION

The present invention refers to a safety device for a breechblock of a firearm, in particular suitable for limiting the possibility of accidental sliding of the breechblock following knocks.

BACKGROUND OF THE INVENTION

Hereafter, specific reference shall be made to a semi-automatic rifle, even though that which is object of the invention can be applied to other types of firearm. Moreover, given that the invention is intended for experts in the field of firearms, we leave out the detailed description of the structure and operation of a firearm, in particular of a rifle like the one described. We make reference only to the functions of the firearm parts involved in the technical problem forming the basis of the invention.

Following hard knocks to the rear part of the stock, such as those generated by the use of the firearm to knock over an obstacle, or in the case of the firearm itself being dropped, the breechblock could translate and move back until it is in open position, consequently causing the involuntary loss of a cartridge in the chamber or involuntarily feeding a cartridge.

Both situations involve a situation of high risk, above all if the user does not realise that a cartridge has involuntarily entered the chamber or that a shot has been missed.

Currently, safety devices for firearms prevent accidental firing of a shot in the barrel by intervening on the sear mechanism, in particular on the trigger or on the firing pin. However, the problem of accidental translation of the breechblock and its consequences on the accidental loading into the chamber or the loss of a cartridge are not tackled.

A safety device for a breechblock should be able to intervene automatically when there is a state of risk and, on the other hand, remain in rest position the rest of the time.

Indeed, a safety element, capable of being inserted and uninserted manually by the user, could be arranged or forgotten in the wrong position. Therefore, the user could find himself unable to fire because he has forgotten the safety inserted or dangerously handling the firearm without having inserted the safety.

SUMMARY OF THE INVENTION

The purpose of the invention is to provide a safety device for a breechblock of a firearm which limits accidental sliding of a breechblock (14) caused by an impact to the firearm, said safety device comprising a locking lever (15) affixed to said breechblock (14) with the locking lever (15) being axially pivoted to the structure of the firearm to allow the locking lever (15) to rotate in axis (11), an elastic return element (18) connected to said locking lever (15), for keeping said locking lever (15) in a rest position during conditions of normal use of the firearm, said locking lever (15) being equipped with an engagement element (19) for engagement with a seat (23) of said breechblock (14) said locking lever (15) being affixed to said breechblock (14) to provide said locking lever (15) with a centre of gravity (G) which is offset with respect to the axis of rotation (11) of said locking lever (15), to cause inertial rotation of said locking lever (15) and engage said seat (23) when said firearm is subjected to an impact.

Another purpose of the present invention is that of realising a safety device for a breechblock which requires low maintenance and which is reliable over time so as not to risk compromising the operation of the entire firearm.

Another purpose of the present invention is that of realising a safety device for a breechblock of a firearm which is particularly simple and functional, with low costs.

DETAILED DESCRIPTION OF THE INVENTION

Figure 1:
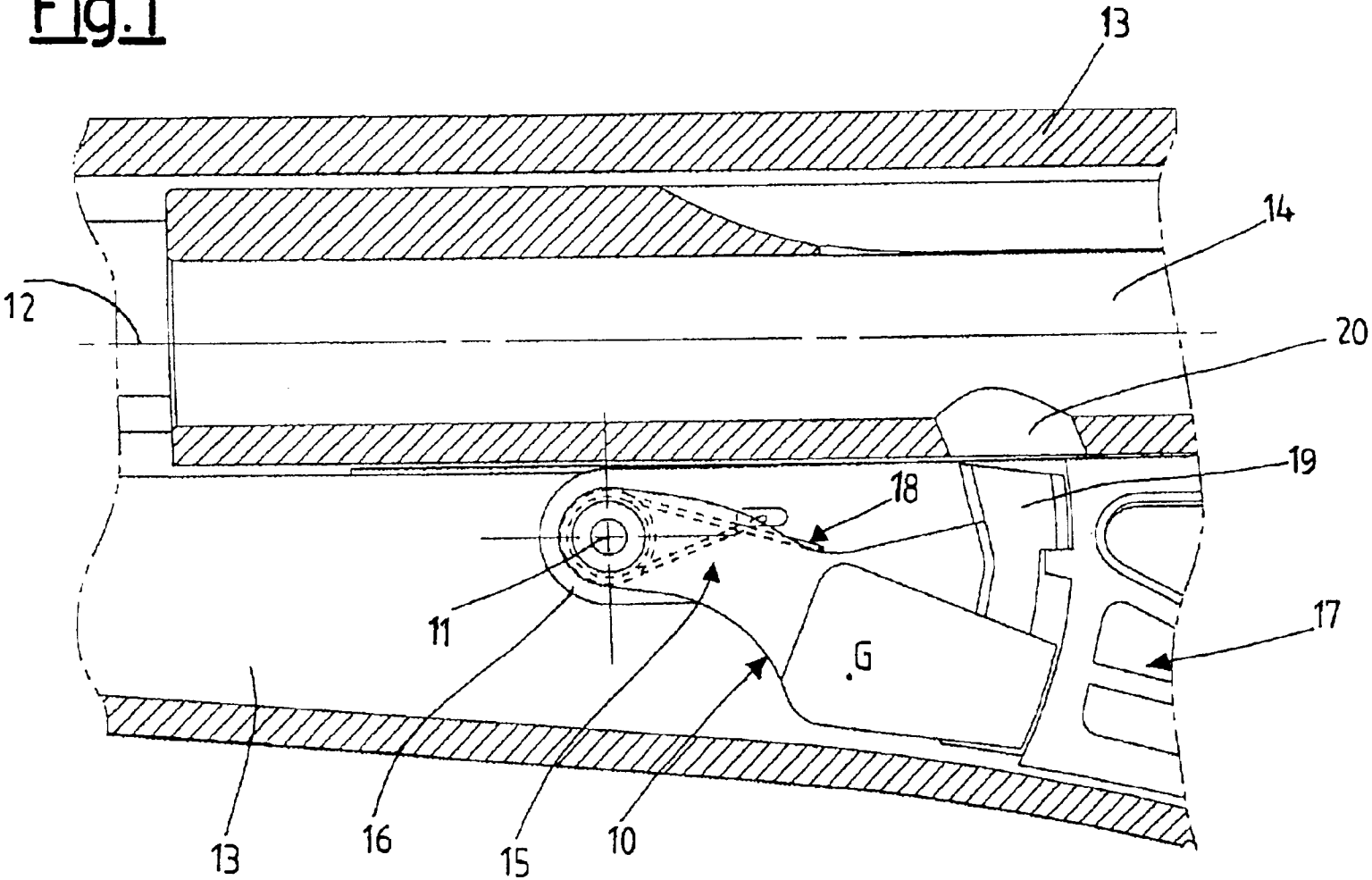
FIG. 1 is a detail of a partial section of a side view of a firearm showing the safety device in a rest position.
Figure 2:
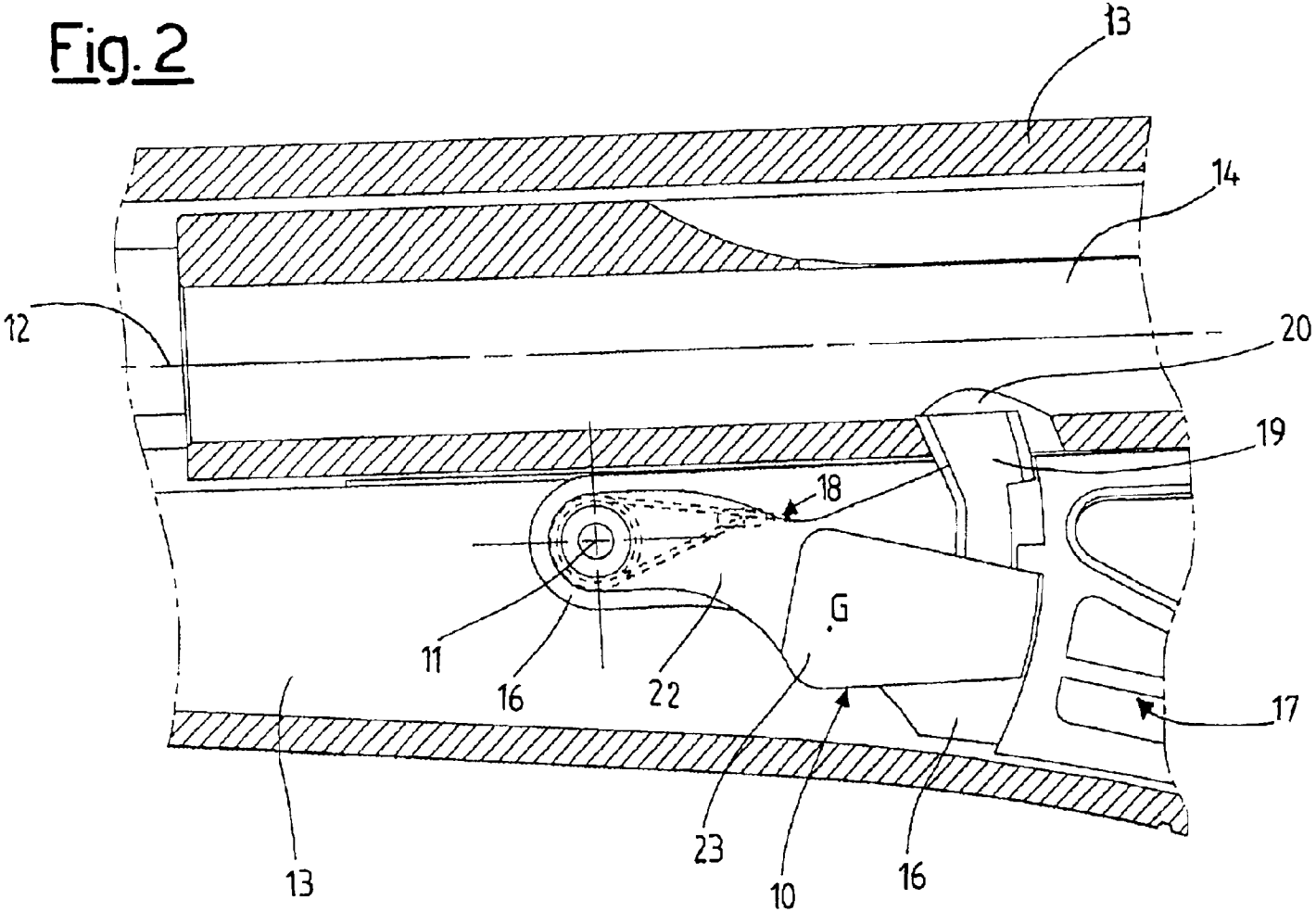
FIG. 2 is a detail of a partial section of a firearm showing the safety device in an engaged position.
Figure 3:
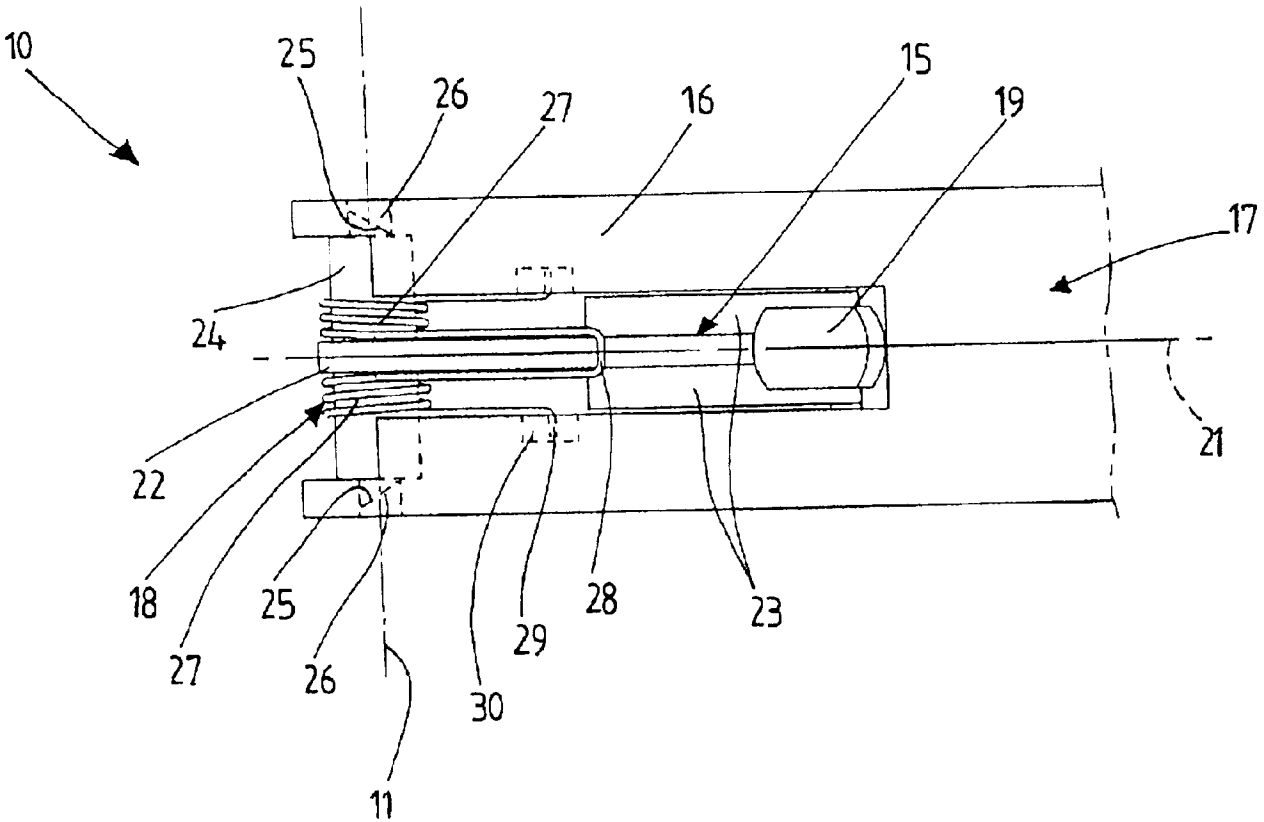
FIG. 3 is a plan view of the safety device for FIGS. 1 and 2.
Figure 4:
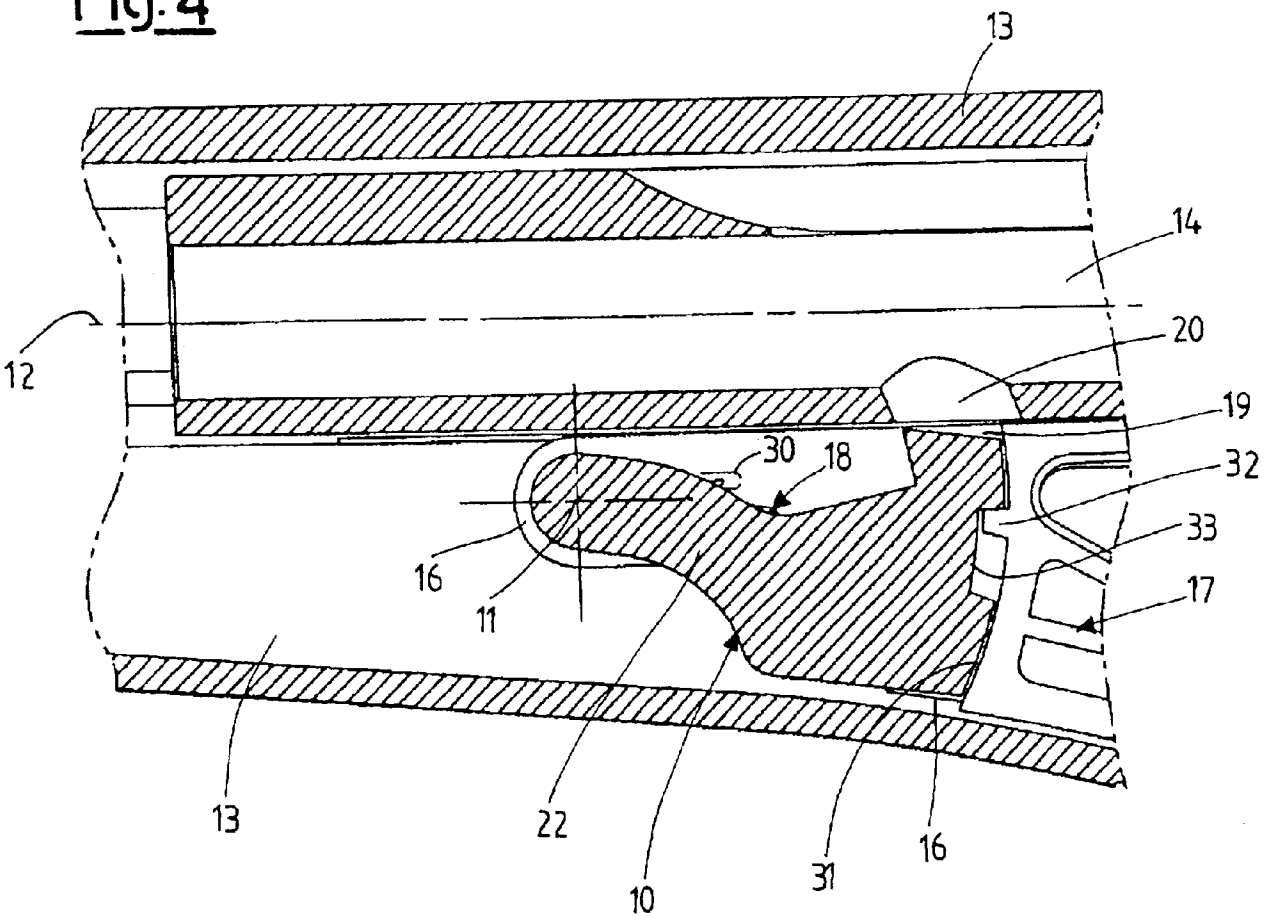
FIG. 4 is a view of the device as shown in FIG. 1 where the safety device is sectioned along its middle plane.
Figure 5:
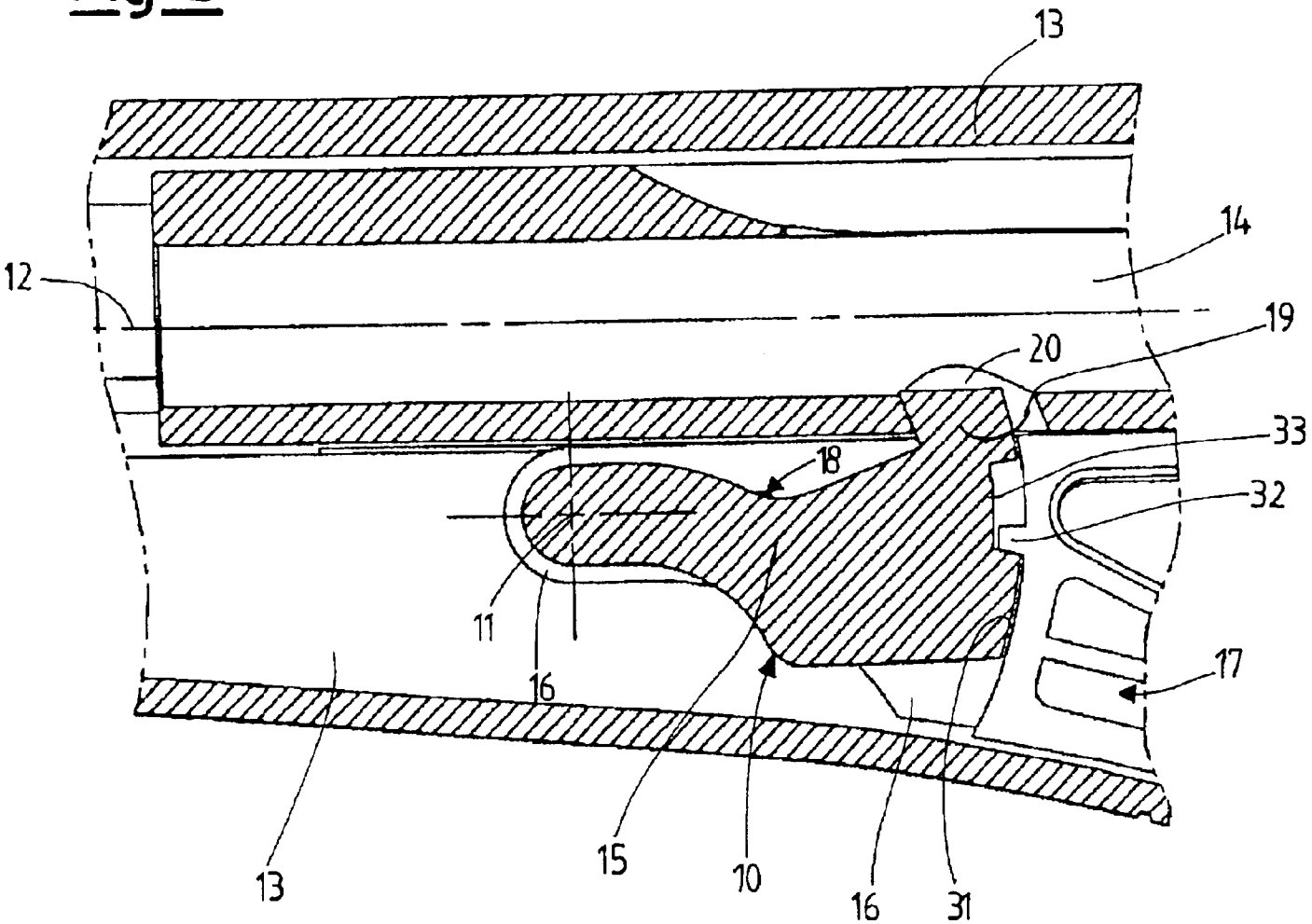
FIG. 5 is a view of the device as shown in FIG. 2 where the safety device is sectioned along its middle plane.

The characteristics and advantages of a safety device for a breechblock according to the present invention shall become clearer from the following description, given as an example and not for limiting purposes, referring to the attached schematic drawings, in which: FIGS. 1 and 2 show a detail of a firearm, partially sectioned carrying a safety device for a breechblock, object of the present invention, represented in rest and engagement position, respectively; FIG. 3 is a plan view of the safety device of FIGS. 1 and 2 applied to a front end of the structure; FIGS. 4 and 5 show the detail of FIGS. 1 and 2 in which the safety device is sectioned along the middle plane.

With reference to the figures a safety device for a breechblock of a firearm is shown as an example and not for limiting purposes, wholly indicated with 10.

The firearm comprises a barrel 12, of which only the axis is indicated, attached to a casing 13 and a breechblock carrier 14, carrying a firing pin, which is not shown.

The components of the firearm are only partially shown, because they are already known in their structure and operation.

In particular, the breechblock 14 can be displaced in a known way from an advanced closing or firing position of the ammunition in the barrel to a set back position opening or cocking the ammunition and vice-versa.

The safety device 10 for a breechblock comprises a breechblock locking lever 15, hinged or pivoted to the structure of the firearm on an axis 11, for example at a front end 16 of a structure 17 of the firearm, as well as an elastic return element 18 of the locking lever 15.

The locking lever 15, equipped with an engagement element 19, for example a tooth with a substantially rectangular section with bevelled corners, facing towards the breechblock 14, intervenes in a seat 20, with a substantially matching shape, realised in the lower wall of the breechblock 14.

The locking lever 15 is realised symmetrically with respect to a middle plane of the firearm, represented in FIG. 3 with a line 21. It comprises a longitudinal neck 22 and a mass 23, which lowers the centre of gravity (G) of the locking lever 15 with respect to the fulcrum, as represented in FIGS. 1 and 2.

The fulcrum of the locking lever 15 of the breechblock 14 consists of a pin 24 which, in a preferred embodiment of the safety device 10 object of the present invention, is realised integral with the lever 15.

The pin 24 has bevelled side engagement projections 25, which ease the pressure assembly operations in two holes 26, aligned with each other on the axis of rotation 11, realised at the front end 16 of the structure, shaped as a fork to house the locking lever 15 and to allow its rotation in the middle plane of line 21.

The elastic return element 18 consists, for example, of a spring, fixed to the connection lever 15 and to the structure 17, which keeps the lever 15 in rest state, thus with the tooth 19 disengaged from the seat 20 of the breechblock 14, during normal use of the firearm. The spring 18, also symmetrical with respect to the middle plane 21, is equipped with two windings 27, arranged on opposite sides of the pin 24 and held in position between the neck 22 of the locking lever 15 and the side walls of the fork 16. The windings 27, joined by a central portion 28 resting upon an upper wall of the neck 22 of the lever, are each equipped with an end 29, fixed in a seat 30 of the front forked end 16 of the structure.

In a preferred embodiment of the safety device 10 for a breechblock, object of the present invention, the locking lever 15 and the front end 16 of the structure have interfacing walls 31 equipped with matching profiles with a cylindrical generatrix, which guide the movement of the lever 15 during its rotation about the pivoting axis 11.

Moreover, the interfacing walls 31 of the lever 15 and of the structure 17 are equipped with abutment elements, which define an upper switch limit position and a lower switch limit position of the rotation of the lever 15, respectively with the tooth 19 engaged in the seat 20 or with such a tooth disengaged from the breechblock 14.

In the example shown, an element 32 protruding from the wall of the structure 17 is engaged in a groove 33 formed on the wall of the lever 15, which slides in the structure.

Through the effect of knocks undergone by the rear part of the structure 17, such as those generated by use of the firearm to knock down an obstacle, or in the case of the firearm itself being dropped, high accelerations are generated acting upon the firearm in the direction in which the breechblock slides and going towards the front part of the firearm.

Under the action of such accelerations, through the effect of the inertia force directed towards the rear part, the breechblock 14 would tend to translate and move back until it is in open position, consequently causing the involuntary loss of a cartridge in the chamber or involuntarily feeding a cartridge.

Such accelerations also act upon the locking lever 15, and in particular upon its mass 23, decentred with respect to the pivoting axis 11. Through the effect of the inertia forces the mass 23 of the locking lever 15 is made to rotate about the fulcrum 11 to align the centre of gravity G of the locking lever 15.

The rotation of the locking lever 15 puts the tooth 19 in engagement in the seat 20 of the breechblock 14, preventing it from moving back under the thrust of the inertia forces.

The elastic element, or spring 18, loaded during the rotary movement, takes the locking lever 15 back into rest position, at the end of the intervention of the inertia forces, and holds it is such a position regardless of vibrations, oscillations or other movements to which the firearm is subjected.

The safety device for a breechblock of a firearm, object of the present invention, advantageously exploits the same physical principle which would cause the accidental translation of the breechblock for its intervention with the breechblock itself.

The safety device for a breechblock of a firearm thus conceived is susceptible to numerous modifications and variants, all covered by the invention. Moreover, all of the details can be replaced with technically equivalent elements. In practice, the materials used, as well as the sizes, can be whatever according to the technical requirements.

What is claimed is:

1. Safety device for a breechblock of a firearm for limiting accidental sliding of said breechblock (14) caused by an impact to the firearm, said safety device comprising a locking lever (15) affixed to said breechblock (14), said locking lever (15) being axially pivoted to a structure of the firearm to allow rotation of said locking lever (15) in an axis of rotation (11), an elastic return element (18) connected to said locking lever (15), for keeping said locking lever (15) in a rest position during conditions of normal use of the firearm, said locking lever (15) being equipped with an engagement element (19) for engagement with a seat (23) of said breechblock (14) and affixed to said breechblock (14) to provide said locking lever (15) with a centre of gravity (G) which is offset with respect to the axis of rotation (11) of said locking lever (15), to cause inertial rotation of said locking lever (15) to cause said locking lever (15) to engage said seat (23) when said firearm is subjected to an impact.

2. Device according to claim 1, wherein said locking lever (15) is pivoted at the front end (16) of a structure (17).

3. Device according to claim 2 wherein said front end (16) of said structure (17) is forked to house said lever (15).

4. Device according to claim 1, wherein said locking lever (15) is pivoted through a pin (24) realized integral with said locking lever (15).

5. Device according to claim 4, wherein said pin (24) is equipped with beveled side engagement projections (25) for pressure assembly in holes (26) aligned on said (11).

6. Device according to claim 1, wherein said elastic return device is a spring (18), connected to said locking lever (15) and to said structure of the firearm.

7. Device according to claim 6, wherein said spring (18) comprises a central portion (28) resting upon an upper wall of said locking lever (15), two windings (27), arranged on opposite sides of a pin (24) of said locking lever (15), as well as two ends (29) fixed to seats (30) of said structure (17).

8. Device according to claim 7, wherein said windings (27) are held in position between a neck (22) of said locking lever (15) and side walls of said structure (17).

9. Device according to claim 1, wherein said engagement element of said locking lever (15) is a tooth (19) facing towards said breechblock (14) for intervention is said seat (20) having a substantially matching shape.

10. Device according to claim 3, wherein locking lever (15) and said front end (16) of the structure have opposed walls (31) with matching cylindrical profiles and abutment elements (32, 33), suitable for defining an upper switch limit position and a lower switch limit position for the rotation of said locking lever (15).

11. Device according to claim 10, wherein said abutment elements consist of and element (32) protruding from said structure (17) and in a groove (33) formed in said locking lever (15).

12. Safety device for a breechblock of a firearm for limiting accidental sliding of said breechblock (14) caused by an impact to the firearm, said safety device comprising a locking lever (15) affixed to said breechblock (14), said locking lever (15) being axially pivoted at a front end (16)

to structure (17) of the firearm to allow rotation of said locking lever (15) in axis of rotation (11), wherein said front end (16) of said structure (17) is forked to house said lever (15), wherein said locking lever (15) and said front end (16) of the structure have opposed walls (31) with matching cylindrical profiles and abutment elements (32, 33), that define an upper limit position and a lower limit position for the rotation of said locking lever (15), an elastic return element (18) connected to said locking lever (15), for keeping said locking lever (15 in a rest position during conditions of normal use of the firearm, said locking lever (15) being equipped with an engagement element (19) for engagement with a seat (23) of said breechblock (14) and affixed to said breechblock (14) to provide said locking lever (15) with a centre of gravity (G) which is offset with respect to the axis of rotation (11) of said locking lever (15), to cause inertial rotation of said locking lever (15) to cause said locking lever (15) to engage said seat (23) when said firearm is subjected to an impact.

13. Device according to claim 12, wherein said abutment elements consist of and element (32) protruding from said structure (17) and in a groove (33) formed in said locking lever (15).

* * * * *